US008003878B2

(12) United States Patent
Gaynier

(10) Patent No.: US 8,003,878 B2
(45) Date of Patent: Aug. 23, 2011

(54) ELECTROACOUSTIC TRANSDUCER SYSTEM

(76) Inventor: David A. Gaynier, South Rockwood, MI (US)

( * ) Notice: Subject to any disclaimer, the term of this patent is extended or adjusted under 35 U.S.C. 154(b) by 111 days.

(21) Appl. No.: 12/498,448

(22) Filed: Jul. 7, 2009

(65) Prior Publication Data

US 2010/0031806 A1 Feb. 11, 2010

Related U.S. Application Data

(60) Provisional application No. 61/137,976, filed on Aug. 5, 2008.

(51) Int. Cl.
*G10H 3/00* (2006.01)

(52) U.S. Cl. ..... 84/723; 84/736; 381/176; 381/355; 381/356; 381/369; D14/225; D14/228

(58) Field of Classification Search ..... 84/723, 84/733, 736, 743; D14/225, 228; 381/176, 381/177, 369, 355, 356
See application file for complete search history.

(56) References Cited

U.S. PATENT DOCUMENTS

| | | | | | |
|---|---|---|---|---|---|
| 1,010,449 | A | * | 12/1911 | O'Connell | 379/452 |
| 1,732,722 | A | * | 10/1929 | Horn | 381/160 |
| 1,899,994 | A | * | 3/1933 | Spotts | 381/160 |
| 2,017,122 | A | * | 10/1935 | Hanson | 381/160 |
| 2,049,586 | A | * | 8/1936 | Hanson et al. | 381/363 |
| 2,165,124 | A | * | 7/1939 | Ballantine | 381/151 |
| 2,227,580 | A | * | 1/1941 | Harry et al. | 381/91 |
| 2,870,856 | A | * | 1/1959 | Olson et al. | 181/242 |
| 2,900,453 | A | * | 8/1959 | Cammack | 381/355 |
| 2,945,408 | A | * | 7/1960 | Terlinde | 84/743 |
| 2,983,901 | A | * | 5/1961 | Paslay et al. | 367/163 |
| 3,472,972 | A | * | 10/1969 | Noss | 381/355 |
| 3,483,940 | A | * | 12/1969 | Weisenthal | 381/91 |
| 3,502,811 | A | * | 3/1970 | Schroeder et al. | 381/91 |
| 3,527,902 | A | * | 9/1970 | Vanliempd | 381/356 |
| 3,881,056 | A | * | 4/1975 | Gibson et al. | 381/160 |
| 3,895,188 | A | * | 7/1975 | Ingraham | 381/160 |
| 3,908,095 | A | * | 9/1975 | Jinsenji | 360/55 |
| 4,264,790 | A | * | 4/1981 | Zlevor | 381/160 |

(Continued)

FOREIGN PATENT DOCUMENTS

DE 4122316 A1 * 1/1993

(Continued)

OTHER PUBLICATIONS

"Blue Microphones Snowball Microphone," http://store.apple.com/us/product/TF2381LL/A, viewed Oct. 27, 2008.

(Continued)

*Primary Examiner* — David S. Warren
(74) *Attorney, Agent, or Firm* — Brooks Kushman P.C.

(57) ABSTRACT

An electroacoustic transducer system for converting sound waves propagating from a musical instrument drum to an electric signal is generally provided. The system includes a housing, an electroacoustic transducer, and a cover. The housing includes a concave inner surface and a convex outer surface. In addition, the housing defines a housing cavity with a mouth. The electroacoustic transducer is disposed in the housing cavity and faces outwardly from the concave inner surface and towards the mouth to receive sound waves propagating from the drum. The electroacoustic transducer receives and converts the sounds waves in the housing cavity to the electric signal. The cover has a generally planar outer surface and extends over the mouth to at least partially enclose the electroacoustic transducer.

12 Claims, 4 Drawing Sheets

U.S. PATENT DOCUMENTS

| | | | | | |
|---|---|---|---|---|---|
| 4,495,641 | A | * | 1/1985 | Vernino | 381/91 |
| 4,497,234 | A | * | 2/1985 | Strnad | 84/743 |
| 4,541,321 | A | * | 9/1985 | Miner, Jr. | 84/379 |
| 4,692,942 | A | * | 9/1987 | Morgand | 381/114 |
| 4,768,614 | A | * | 9/1988 | Case | 181/148 |
| D324,219 | S | * | 2/1992 | Besasie | D14/225 |
| D351,840 | S | * | 10/1994 | Hillier et al. | D14/228 |
| 5,430,245 | A | * | 7/1995 | Rogers | 84/725 |
| 5,548,656 | A | * | 8/1996 | Weisel | 381/122 |
| 5,579,398 | A | * | 11/1996 | Ewens | 381/338 |
| 5,898,789 | A | * | 4/1999 | Nichols et al. | 381/361 |
| 6,031,920 | A | * | 2/2000 | Wiener | 381/160 |
| 6,069,958 | A | * | 5/2000 | Weisel | 381/56 |
| 6,134,332 | A | * | 10/2000 | Wiener | 381/160 |
| D441,354 | S | * | 5/2001 | Jing | D14/228 |
| D457,876 | S | * | 5/2002 | Chung | D14/228 |
| 6,408,080 | B1 | * | 6/2002 | Koizumi | 381/160 |
| 6,438,238 | B1 | * | 8/2002 | Callahan | 381/67 |
| D475,038 | S | * | 5/2003 | Jarodsky et al. | D14/228 |
| D475,039 | S | * | 5/2003 | Thornton et al. | D14/228 |
| D475,040 | S | * | 5/2003 | LaPoint | D14/228 |
| 6,625,288 | B1 | * | 9/2003 | Koizumi | 381/160 |
| D481,709 | S | * | 11/2003 | Solderits | D14/228 |
| D529,484 | S | * | 10/2006 | Probst | D14/228 |
| D539,790 | S | * | 4/2007 | Wang | D14/228 |
| 7,256,342 | B2 | | 8/2007 | Hagiwara et al. | |
| 7,282,633 | B1 | * | 10/2007 | Coolidge | 84/723 |
| 7,297,863 | B2 | | 11/2007 | May | |
| 7,352,873 | B2 | * | 4/2008 | Shigeno et al. | 381/113 |
| D576,612 | S | * | 9/2008 | Wilson et al. | D14/228 |
| D584,295 | S | * | 1/2009 | Kellar | D14/228 |
| 7,609,843 | B2 | * | 10/2009 | Hatano et al. | 381/356 |
| D604,274 | S | * | 11/2009 | Durrett et al. | D14/228 |
| 2003/0221545 | A1 | * | 12/2003 | Tomoda | 84/723 |
| 2004/0076305 | A1 | * | 4/2004 | Santiago | 381/356 |
| 2004/0114778 | A1 | * | 6/2004 | Gobeli et al. | 381/356 |
| 2004/0202343 | A1 | * | 10/2004 | Rye et al. | 381/353 |
| 2004/0211310 | A1 | * | 10/2004 | Hagiwara et al. | 84/726 |
| 2005/0150366 | A1 | * | 7/2005 | Susami | 84/735 |
| 2006/0272490 | A1 | * | 12/2006 | May | 84/743 |
| 2007/0183607 | A1 | * | 8/2007 | Andrews et al. | 381/160 |
| 2007/0295189 | A1 | * | 12/2007 | Kelly | 84/421 |
| 2008/0034946 | A1 | * | 2/2008 | Aimi | 84/604 |
| 2008/0075312 | A1 | * | 3/2008 | Lan et al. | 381/356 |
| 2009/0316927 | A1 | * | 12/2009 | Ferrill | 381/91 |
| 2010/0031806 | A1 | * | 2/2010 | Gaynier | 84/723 |

FOREIGN PATENT DOCUMENTS

JP 2007043516 A * 2/2007

OTHER PUBLICATIONS

"Audix SCX-25 Studio Condenser Microphone," http://www.audixusa.com/docs/specs_pdf/SCX25_spec_sheet.pdf, viewed Nov. 13, 2008.

"Blue 8 Ball Microphone Cardioid Condenser," http:://www.macfriends.com/blue-8-ball-microphone-cardioid-condenser.aspx, viewed Oct. 28, 2008.

"Yamaha SKRM-100 SUBKICK Bass Drum Microphone," http://www.yamaha.com/yamahavgn/CDA/ContentDetail/ModelSeries-Detail/0,,CNTID%25253D25075%252526CTID%25253D217200-%252526ATRID%25253D20%252526DETYP%25253DATTRI-BUTE,00.html, viewed Jul. 30, 2009.

"Shure SM81," http://www.mediacollege.com/equipment/shure/microphone/sm81.html, viewed Nov. 13, 2008.

Yamaha Dynamic Microphone "Subkick" SKRM-100.

* cited by examiner

ELECTROACOUSTIC TRANSDUCER SYSTEM

CROSS-REFERENCE TO RELATED APPLICATION

This application claims the benefit of the U.S. Provisional Application filed Aug. 5, 2008, and having Application No. 61/137,976, the entire disclosure of which is incorporated by reference herein.

BACKGROUND

1. Field of the Invention

This invention relates to an electroacoustic transducer system for a musical instrument drum.

2. Background Art

A dynamic microphone is an instrument having a transducer with a diaphragm to convert mechanical energy of sounds waves into an electric signal. Many microphones are specifically designed to pick up a sound from a musical instrument within a particular frequency range. For example, some microphones are specifically designed to pick up a low-frequency sound from a drum, such as a bass drum, a snare drum, tom-tom drum, a bongo drum, etc. Further, various attempts have been made in an effort to improve the sound quality of microphones. However, many microphones produce an electric signal that distorts or inaccurately reproduces the low-frequency sound that a drum generates.

Prior art patents include U.S. Pat. Nos. 7,256,342; and 7,297,863; and U.S. Published Patent Application Nos. 2004/0159018A1; 2002/0083622; and 2001/0003876.

SUMMARY

An electroacoustic transducer system for converting sound waves propagating from a musical instrument drum to an electric signal is provided. The electroacoustic transducer system includes a housing, an electroacoustic transducer, and a cover having a generally planar outer surface. The housing defining a housing cavity with a mouth and includes a concave inner surface and a convex outer surface. The outer surface deflects unwanted sound waves outwardly away from the housing cavity. The electroacoustic transducer is disposed in the housing cavity and faces outwardly from the concave inner surface and towards the mouth of the housing. The electroacoustic transducer receives sound waves propagating from the drum, through the mouth, and into the housing cavity. In addition, the electroacoustic transducer converts the sounds waves in the housing cavity to the electric signal for transmission to a peripheral device. The cover extends over the mouth of the housing to at least partially enclose the electroacoustic transducer.

The electroacoustic transducer may include a diaphragm, an electric circuit, and an electric signal port. The diaphragm vibrates in response to the sound waves from the drum and the electric circuit converts the vibration of the diaphragm to the electric signal. The electric signal port transfers the electric signal from the electric circuit to the peripheral device.

The electric signal can have a polarity corresponding to a phase of the sound waves from the drum. The electroacoustic transducer may have a switch that is electrically connected between the electric circuit and the signal port to invert a polarity of the electric signal transmitted to the signal port. In addition, the electric circuit may have an electric impedance of approximately 250 ohms to enhance quality of the electric signal as the electric signal is transferred from the electroacoustic transducer system to the peripheral device.

The generally planar surface of the cover may define a plurality of apertures through which the sound waves from the drum can enter the housing cavity. Furthermore, the cover may facilitate acoustic alignment between the drum and the electroacoustic transducer. In operation, the electroacoustic transducer may receive the sound waves according to a substantially cardioid polar pattern. In addition, the convex outer surface may have a radius of curvature between 6 and 6.5 inches. Furthermore, the outer surface may be partially hemispherically domed.

The electroacoustic transducer system may include a mounting ring. The mounting ring secures the electroacoustic transducer in the housing cavity between the concave inner surface and the collar of the housing. Furthermore, the housing may include a tapered edge as well as a collar having a lip. The tapered edge joins the convex outer surface and the collar. The collar may support the mounting ring in the housing between the lip and the mouth of the housing. In addition, the mounting ring may support the cover on the lip of the collar at a distance from the electroacoustic transducer.

The housing may define a plurality of vent openings between the concave inner surface and the convex outer surface. In operation, the vent openings substantially equalize air pressure inside the housing with air pressure outside the housing. Furthermore, the vent openings may be spaced from each other at predetermined positions in the housing to facilitate uniform air pressure equalization between air inside the housing and air outside the housing. In addition, the vent openings may be spaced at generally uniform distances from a longitudinal axis of the convex outer surface to facilitate uniform air pressure equalization between air inside the housing and air outside the housing.

DETAILED DESCRIPTION

Embodiments of the present invention generally provide an electroacoustic transducer system for converting sound waves propagating from a musical instrument drum to an electric signal. The electroacoustic transducer system may also transmit the electric signal to a peripheral device, such as an amplifier or speaker unit.

Figure 1:
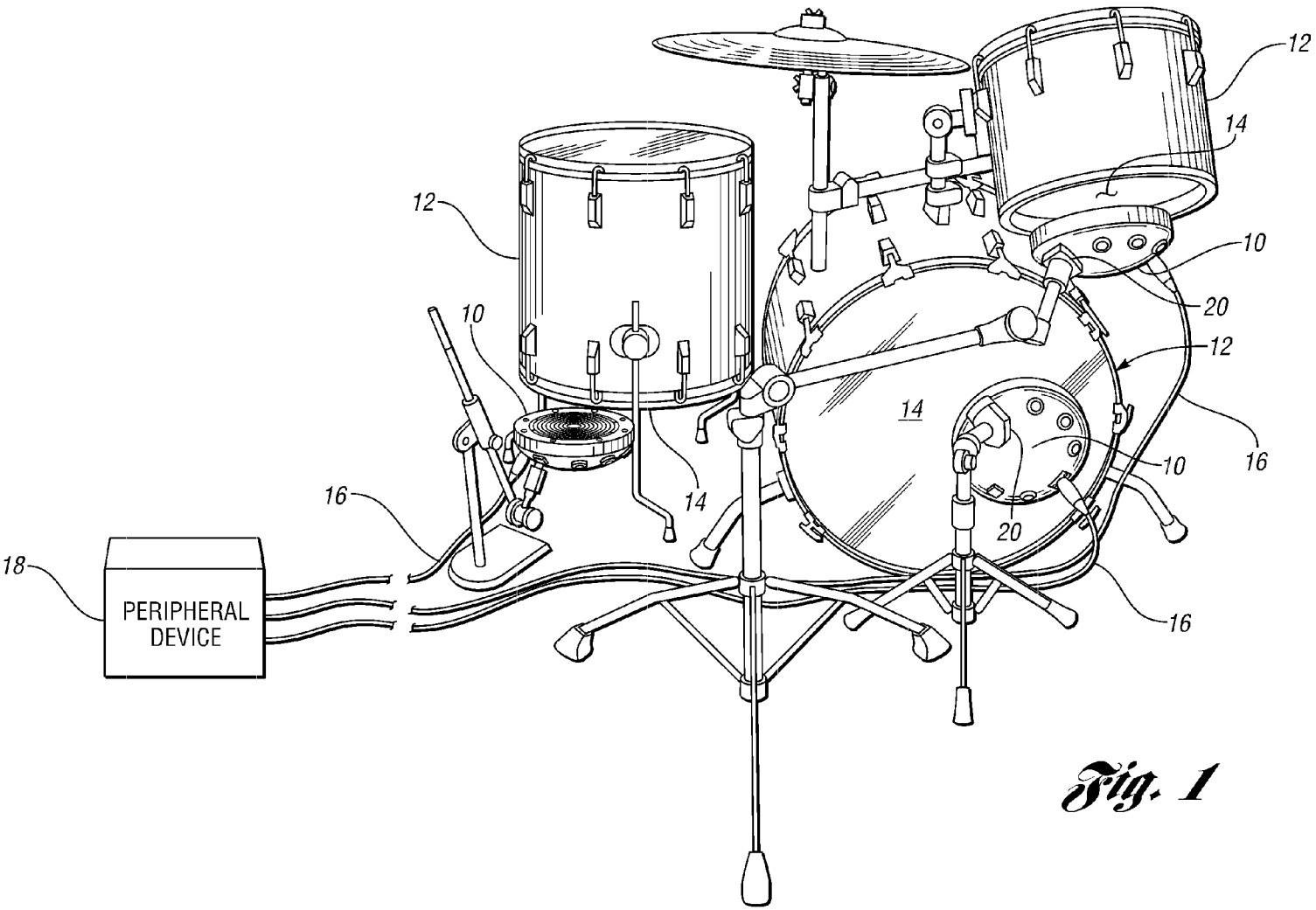
FIG. 1 is a perspective view illustrating three musical instrument drums and an electroacoustic transducer system positioned relative to each of the drums.

With reference to FIG. 1, an electroacoustic transducer system 10 (hereinafter "system") for converting sound waves from a musical instrument drum 12 (hereafter "drum") to an electric signal is generally provided. The electric signal can have a polarity corresponding to a phase of the sound waves from the drum 12. For example, a positive polarity of the electric signal can correspond to the sound waves causing increased air pressure outside the system 10 while a negative polarity can correspond to the sound waves causing deceased air pressure inside the system 10.

FIG. 1 depicts three drums, each of which has a drumhead 14 and corresponding system 10. The system 10 is positioned relative to the drumhead 14 of the drum 12 to receive the sound waves propagating from the drum 12. The system 10 may be positioned relative to the drumhead 14 to facilitate acoustic alignment between the drum 12 and the system 10. Vibrating the drumhead 14 causes the sounds waves to propagate through air around the drum 12 and toward the system 10. In addition, each system 10 shown in FIG. 1 shields background noise as well as sound waves generated from the other two drums (i.e., the two drums that the system 10 is not directed toward). Thus, the system 10 may be considered unidirectional since the system 10 receives sound waves from a particular direction.

With continuing reference to FIG. 1, a conduit or cable 16 can be connected to the system 10 to transfer the electric signal from the system 10 to a peripheral device 18. For example, the peripheral device 18 can be an amplifier or a speaker unit. When the electric signal has positive polarity, an compression that reaches the system 10 can be reproduced at the peripheral device 18 as a compression that reaches a listener's ears. Similarly, when the electric signal has negative polarity, an compression that reaches the system 10 can be reproduced at the peripheral device 18 as a decompression that reaches the listener's ears. In addition, the system 10 may be adapted to receive a mounting bracket 20 to support and position the system 10 relative to the drum 12.

Figure 2:
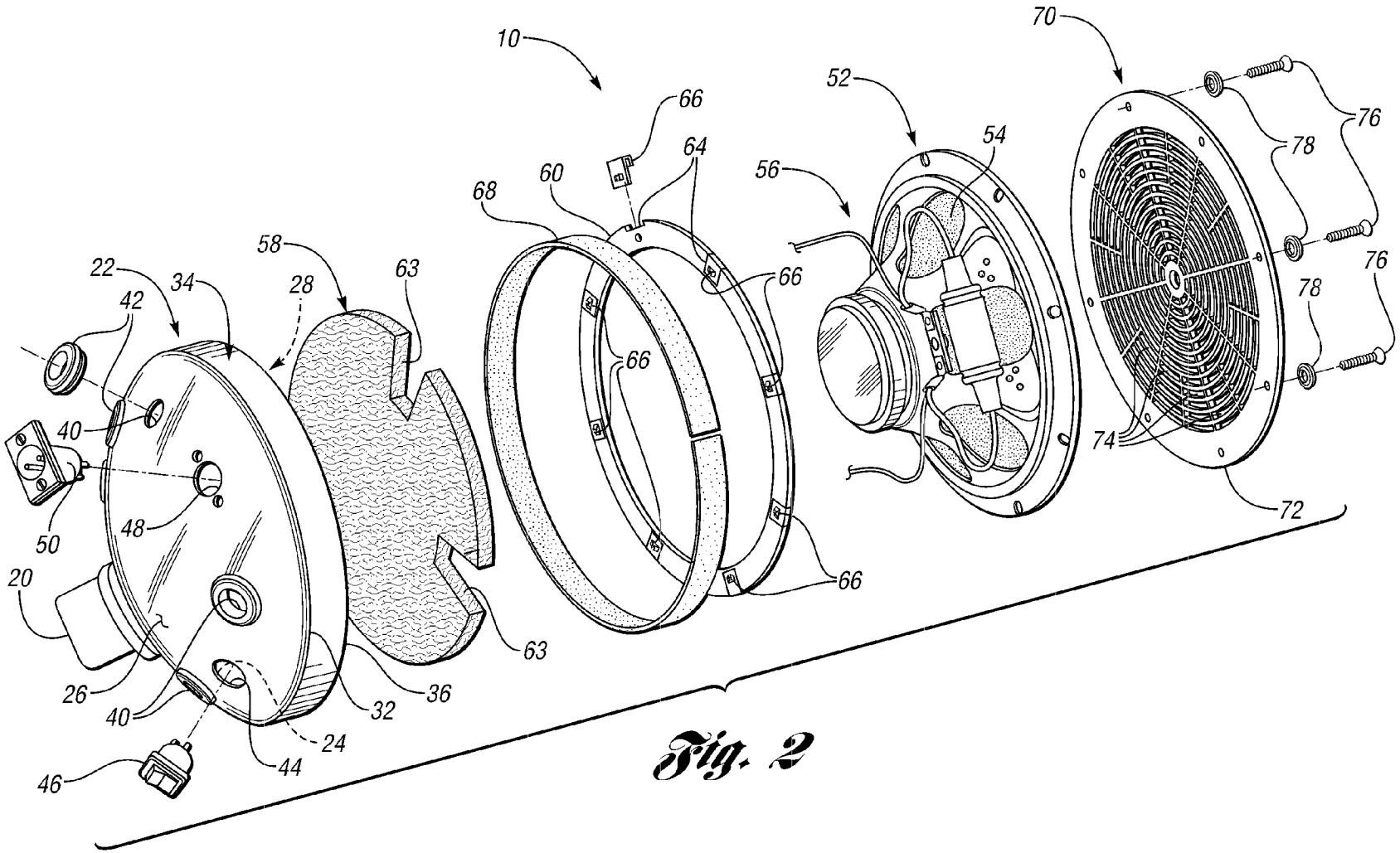
FIG. 2 is an exploded perspective view illustrating the electroacoustic transducer system including a housing, a sheet of padding, a spacer, a mounting ring, an electroacoustic transducer, and a cover.

With reference to FIG. 2, the system 10 includes a housing 22. The housing 22 includes a concave inner surface 24 and a convex outer surface 26. As shown, the inner and outer surfaces 24, 26 may be partially hemispherically domed. In addition, the housing 22 defines a housing cavity 28 with a mouth 30 (better shown in FIGS. 4 and 6). The sound waves from the drum 12 enter the housing cavity 28 through the mouth 30 of the housing 22 for producing the electric signal. The housing 22 may also include a tapered edge 32 and a collar 34 having a lip 36. The tapered edge 32 joins the convex outer surface 26 and the collar 34 of the housing 22. The lip 36 provides structural rigidity to the housing 22 including the collar 34.

As shown in FIG. 2, the housing 22 may include a plurality of vent openings 40. The vent openings 40 extend completely through the inner and outer surfaces 24, 26 of the housing 22. The vent openings 40 allow pressure inside the housing 22 to substantially equalize with air pressure outside the housing 22. For example, the vent openings 40 can allow air pressure in the housing cavity 28 to equalize air pressure outside the convex outer surface 26 of the housing 22 when sound waves enter the housing cavity 28 and increase the air pressure in the housing cavity 28.

As illustrated in FIG. 2, the housing 22 may include a plurality of grommets 42 for each of the vent openings 40. As shown, the grommets 42 are fitted to the vent openings 40. The grommets 42 may be made of any suitable material, such as a rubber or a polymer. The grommets 42 protect the housing 22 from impacts and other forces that may dent or damage the convex outer surface 26 of the housing 22. Furthermore, the grommets 42 may channel air flowing through the vent openings 40 to facilitate air pressure equalization between air pressure inside the housing cavity 28 and air pressure outside the housing 22.

With continuing reference to FIG. 2, the housing 22 may include a switch hole 44. The switch hole 44 is adapted to receive a switch 46. For example, the switch 46 may be a toggle switch, such as a DPDT rocker switch. In addition, the housing 22 may include a port hole 48 that is adapted to receive an electric signal port 50.

Figure 3:
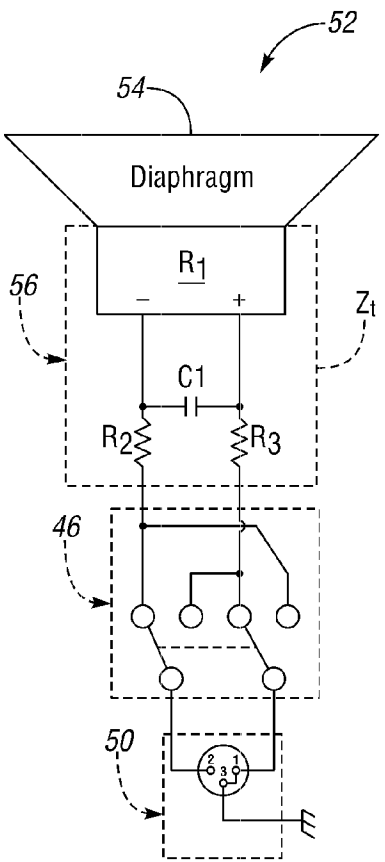
FIG. 3 is a schematic diagram illustrating the electroacoustic transducer having a diaphragm, an electric circuit, a switch, and an electric signal port.

As illustrated in FIGS. 2-3, the system 10 includes an electroacoustic transducer 52. The electroacoustic transducer 52 may include a diaphragm 54, an electric circuit 56, the switch 46, and the electric signal port 50, or a combination thereof. The diaphragm 54 receives the sound waves propagating from the drum 12 and, in response to the sound waves, vibrates within a frequency range. For example, the frequency range may be between 40 hertz (Hz) and 18 kilohertz (kHz). The diaphragm 54 can have any suitable diameter that allows the electroacoustic transducer 52 to be inserted in the housing 22. For example, the diameter of the diaphragm 54 may be about eight inches.

Referring to FIG. 3, the electric circuit 56 converts vibration of the diaphragm 54 to the electric signal. The electric signal port 50 receives the electric signal and transfers the electric signal from the electric circuit 56 to the peripheral device 18 (shown in FIG. 1). The electric circuit 56 includes a capacitor $C_1$ and resistors $R_1$, $R_2$, and $R_3$. The values of the capacitor $C_1$ and the resistors $R_1$, $R_2$, and $R_3$ can be selected to create a filter that converts the vibrations of the diaphragm 54 into the electric signal embedded or encoded with the low frequencies that the drum 12 produces. For example, the electric circuit 56 can have a total impedance $Z_t$ of approximately 250 ohms (250Ω) to enhance the low-frequency qualities of the electric signal as the electric signal is transferred from the system 10 to the peripheral device 18. The capacitor $C_1$ may have a capacitance of 220 μF and resistors $R_1$, $R_2$, and $R_3$ may have respective impedances of 8 ohms, 22 ohms, and 220 ohms to make the total impedance $Z_t$ of the electric circuit 56 approximately 250 ohms.

The electric circuit 56 can operate as a low-pass filter that passes frequencies below 200 hertz that the electroacoustic transducer 52 receives from the drum 12 while reducing or attenuating the magnitude of frequencies above 200 hertz. Thus, the electric circuit 56 may decrease the magnitude of frequencies above 200 hertz that are embedded in the electric signal while maintaining or increasing the magnitude of frequencies below 200 hertz in the electric signal. Furthermore, the electric circuit 56 may operate as a band-pass filter that filters the electric signal to obtain a desired passband of frequencies. The passband may be between 0 and 250 hertz. For example, the desired passband can be between 20 and 200 hertz with relatively smooth attenuation above 200 hertz when the electroacoustic transducer 52 includes capacitor $C_1$ with a capacitance of 220 μF and resistors $R_1$, $R_2$, and $R_3$ with respective impedances of 8 ohms, 22 ohms, and 220 ohms.

The electroacoustic transducer 52 of FIG. 3 includes the electric signal port 50 and the switch 46. The switch 46 is electrically connected between the electric circuit 56 and the signal port 50. The switch 46 is provided to selectively invert the polarity of the electric signal transmitted to the signal port 50 while the signal port 50 is adapted to receive the cable 16. The cable 16 transfers the electric signal from the signal port 50 to the peripheral device 18. For example, the signal port 50 may be a SWCRD3 MB Switchcraft D3 MB Chassimount Male XLR.

Figure 4:
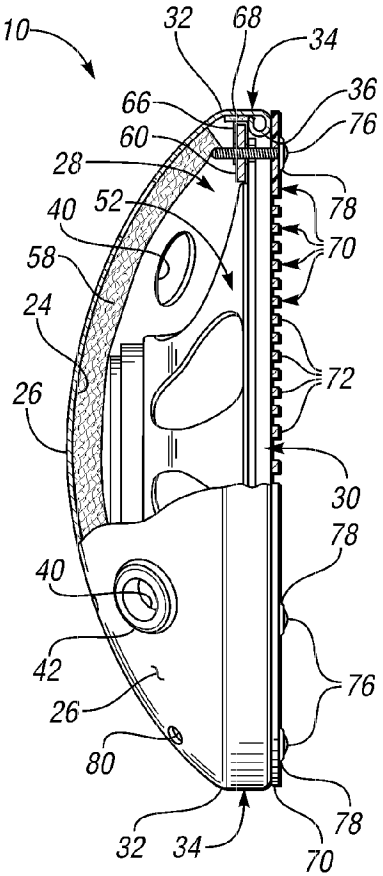
FIG. 4 is a sectional view illustrating the cover enclosing the sheet of padding, the spacer, the mounting ring, and the electroacoustic transducer in the housing of the electroacoustic transducer system.

Referring to FIGS. 2 and 4, the system 10 may include a sheet of padding 58 and a mounting ring 60 disposed between the housing 22 and the electroacoustic transducer 52. The mounting ring 60 may include a plurality of recesses 64 to receive respective clips 66 for securing the electroacoustic transducer 52 in the housing cavity 28. The padding 58 is positioned between the concave inner surface 24 of the housing 22 and the mounting ring 60. As shown in FIG. 2, the padding 58 may have one or more slots 63 to facilitate assembly of the switch 46 to the electric circuit 56 and the electric signal port 50. The mounting ring 60 is positioned between the padding 58 and the electroacoustic transducer 52.

As shown in FIGS. 2 and 4, the system 10 may include a spacer 68. For example, the spacer 68 may include foam layer with an adhesive layer that adheres the spacer 68 to the concave inner surface 24 of the housing 22. The spacer 68 secures the mounting ring 60 in the housing 22 between the sheet of padding 58 and the lip 36 of the housing 22. The spacer 68 may flex or compress to receive and support the mounting ring 60 in the housing cavity 28. Thus, the mounting ring 60 may be pressure fit or friction fit against the spacer 68 to hold the electroacoustic transducer 52 in the housing 22.

With continuing reference to FIGS. 2 and 4, the system 10 includes a cover 70. The cover 70 extends over the mouth 30 of the housing 22 to at least partially enclose the electroacoustic transducer 52. The cover 70 includes a generally planar outer surface 72. The planar outer surface 72 of the cover 70 facilitates acoustic alignment between the drum 12 and the system 10 as shown in FIG. 1. In addition, the generally planar outer surface 72 allows the electroacoustic transducer 52 to be positioned relatively close to the drumhead 14 of the drum 12 so that the housing 22 captures the sound waves from the drum 12 and not unwanted noise or sound coming from something other than the drum 12 that the system 10 is directed toward. In addition, the generally planar outer surface 72 facilitates collection of the sound waves from the drum 12 while protecting the electroacoustic transducer 52 in the housing cavity 28.

As depicted in FIG. 2, the generally planar surface 72 of the cover 70 may define a plurality of apertures 74. The sound waves from the drum 12 can enter the housing cavity 28 through the apertures 74 in the cover 70. With the apertures 74 in the cover 70, the cover 70 acts as a grille that allows sound waves to enter the housing cavity 28 while protecting the electroacoustic transducer 52 in the housing cavity 28. The apertures 74 in the cover 70 of FIG. 2 are shown as concentric apertures. However, the apertures 74 can be arranged in any suitable pattern for the electroacoustic transducer 52 to receive the sound waves.

As shown in FIG. 4, the housing 22 supports the mounting ring 60 between the lip 36 of collar 34 and the mouth 30 of the housing 22. The mounting ring 60 secures the electroacoustic transducer 52 in the housing cavity 28 between the concave inner surface 24 and the collar 34 of the housing 22. Furthermore, the mounting ring 60 supports the cover 70 on the lip 36 of the collar 34 at a distance from the electroacoustic transducer 52.

Referring again to FIGS. 2 and 4, the system 10 may include a plurality of fasteners 76 and washers 78. For example, the fasteners 76 may be screws or threaded bolts. The fasteners 76 secure the cover 70 to the electroacoustic transducer 52 as well as the electroacoustic transducer 52 to the mounting ring 60. The recesses 64 in the mounting ring 60 receive the respective clips 66 at predetermined positions around the outer perimeter of the mounting ring 60. The recesses 64, the clips 66, or both can be threaded to receive the fasteners 76.

As shown in FIG. 4, the electroacoustic transducer 52 is disposed in the housing cavity 28. In addition, the electroacoustic transducer 52 faces outwardly from the concave inner surface 24 of the housing 22. Furthermore, the electroacoustic transducer 52 faces towards the mouth 30 of the housing 22 to receive sound waves propagating from the drum 12, through the mouth 30, and at the electroacoustic transducer 52 in the housing cavity 28. The electroacoustic transducer 52 converts the sounds waves in the housing cavity 28 to the electric signal for transmission to the peripheral device 18.

Figure 5:
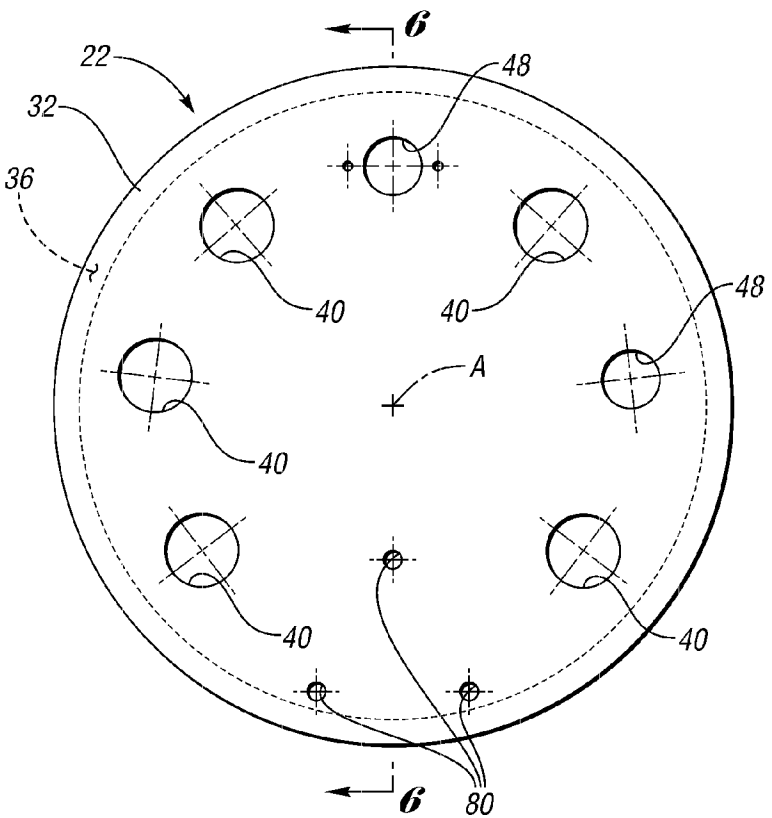
FIG. 5 is a top view illustrating the housing defining a switch hole for an electric switch, a port hole for an electric signal port, and a plurality of vents openings.

As shown in FIG. 5, the housing 22 may include a plurality of mounting holes 80 to receive the mounting bracket 20. The mounting holes 80 extend completely through the inner and outer surfaces 24, 26 of the housing 22. FIG. 5 shows the housing 22 having three mounting holes 80. However, the housing 22 may have fewer or more than three mounting holes 80 depending on the particular configuration of the system 10.

Figure 6:
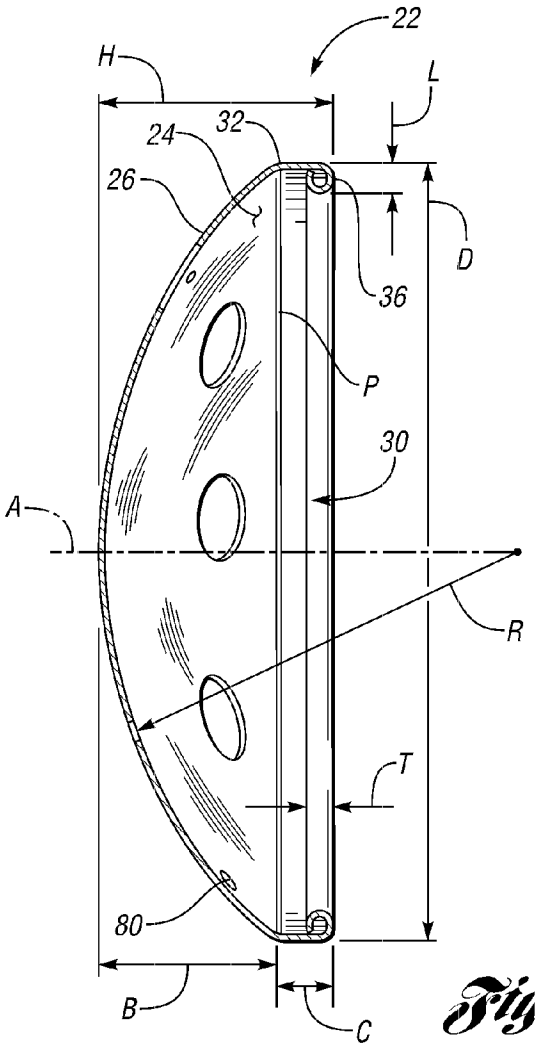
FIG. 6 is a cross-sectional view taken along line 6-6 through the housing and illustrating the housing having a concave inner surface, a convex outer surface, a collar with a lip, and a tapered edge joining the convex outer surface and the collar.

With reference to FIGS. 5-6, the vent openings 40 may be spaced from each other at predetermined positions in the housing 22 to facilitate uniform air pressure equalization between air inside the housing 22 and air outside the housing 22. As shown, the housing 22 has a longitudinal axis A. Longitudinal axis "A" may also define the longitudinal axis of the inner and outer surfaces 24, 26. The vent openings 40 may be spaced at generally uniform distances from Longitudinal axis A to facilitate uniform air pressure equalization between air inside the housing 22 and air outside the housing 22.

As illustrated in FIG. 6, the collar 34 of the housing 22 generally has a diameter D. In addition, the inner and outer surfaces 24, 26 of the housing 22 have a generally uniform radius of curvature R. The radius of curvature R may be between 6 and 6.5 inches. Furthermore, the housing 22 has a height H, a rise length B, and a collar depth C. The length B defines a distance between a plane "P" intersecting the tapered edge 32 of the housing 22 and the convex outer surface 26 while the height H defines a distance between where the convex outer surface 26 intersects the longitudinal axis A and the lip 36 of the collar 34. The diameter D, the length B, the collar depth C, the height H, and the radius of curvature R define the housing cavity 28 as well as the acoustical characteristics of the system 10. Based on the acoustical characteristics of the system 10, the system 10 can receive the sound waves from the drum 12 according a number of difference cardioid polar patterns. For example, the diameter D may be about 8.75 inches, the length B may be 1.75 inches, the collar depth C may be 0.875 of an inch, the height H may be 2.625 inches, and the radius of curvature R may be 6.25 inches for the system 10 to receive the sound waves according to a substantially cardioid polar pattern.

With continuing reference to FIG. 6, the lip 36 of the collar 34 has a length L and a thickness T. The length L defines a distance that the lip 36 extends radially inward from the outer surface of the collar 34. The thickness T defines a distance that the lip 36 curls inwardly toward the housing cavity 28. For example, the length L may be about 0.275 of an inch and the thickness T may be 0.250 of an inch.

Figure 7:
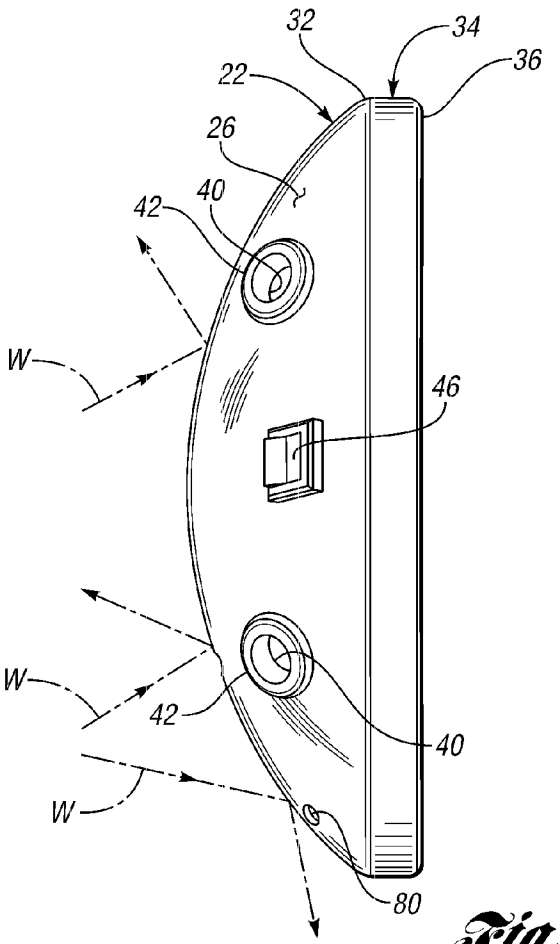
FIG. 7 is a side view illustrating the convex outer surface of the housing deflecting unwanted sound waves outwardly away from the electroacoustic transducer system.

As illustrated in FIG. 7, the convex outer surface 26 of the housing 22 deflects unwanted sound waves labeled "W" outwardly away from the housing 22. Similarly, the outer surface 26 deflects the unwanted sound waves W away from the housing cavity 28 where the electroacoustic transducer 52 is positioned. The diameter D, the length B, the collar depth C, the height H, and the radius of curvature R of the housing 22

(shown in FIG. 6) determine how the convex outer surface 26 deflects or shields the unwanted sound waves W. The switch 46 of FIG. 7 is shown secured to the housing 22 at about equal distances between two of the vent openings 40. However, the switch 46 may be secured to the housing 22 at different positions depending on the particular configuration of the system 10.

While one embodiment of the invention has been illustrated and described, it is not intended that this embodiment illustrates and describes all possible forms of the invention. Rather, the words used in the specification are words of description rather than limitation, and it is understood that various changes may be made without departing from the spirit and scope of the invention.

What is claimed is:

1. An electroacoustic transducer system for converting sound waves propagating from a musical instrument drum having acoustic characteristics to an electric signal for transmission to a peripheral device, the system comprising:

a housing having a rise length B and including a collar having a depth C and diameter D, a concave inner surface and a convex outer surface, the housing defining a housing cavity with a mouth defined by the collar;

an electroacoustic transducer disposed in the housing cavity and having a diaphragm at least partially disposed within the mouth and facing outwardly from the mouth of the housing to receive sound waves propagating from the musical instrument drum, the electroacoustic transducer converting the sounds waves to the electric signal for transmission to the peripheral device; and a cover having a generally planar outer surface and extending over the mouth of the housing to at least partially enclose the electroacoustic transducer;

wherein the housing rise length B, the collar depth C, and the collar diameter D are selected to facilitate acoustic characteristics of sounds waves received from the drum.

2. The system of claim 1 wherein the convex inner surface of the housing defines a radius of curvature R between 6 and 6.5 inches.

3. The system of claim 1 wherein the diameter D of the collar is about 8.75 inches.

4. The system of claim 1 wherein the length B is 1.75 inches.

5. The system of claim 1 wherein the length C is 0.875 of an inch.

6. The system of claim 1 wherein the diaphragm has a frequency range between 40 hertz and 18 kilohertz.

7. The system of claim 1 wherein the convex outer surface of the housing is partially hemispherically domed and reaching to an apex.

8. The system of claim 1 further including a mounting ring with a diameter less than diameter D of the collar to secure a diaphragm-side of the electroacoustic transducer inside a portion of the housing cavity defined by the collar.

9. The system of claim 1 wherein the housing defines a plurality of vent openings between the concave inner surface and the convex outer surface, the convex outer surface having a longitudinal axis and the vent openings being spaced at generally uniform distances from the longitudinal axis to facilitate air pressure equalization between air inside the housing and air outside the housing.

10. The system of claim 1 wherein the electroacoustic transducer includes an electric circuit having an electric impedance of approximately 250 ohms to enhance quality of the electric signal as the electric signal is transferred from the electroacoustic transducer to the peripheral device.

11. The system of claim 10 wherein the electric circuit filters the electric signal to obtain a desired passband of frequencies between 20 and 200 hertz.

12. The system of claim 10 wherein the electric circuit includes a capacitor having a capacitance of about 220 μF as well as first, second, and third resistors with impedances of about 8 ohms, 22 ohms, and 220 ohms, respectively.

* * * * *